US008987671B2

(12) United States Patent
Nutzel et al.

(10) Patent No.: US 8,987,671 B2
(45) Date of Patent: Mar. 24, 2015

(54) COMPACT IMAGE INTENSIFIER TUBE AND NIGHT VISION SYSTEM FITTED WITH SUCH A TUBE

(75) Inventors: Gert Nutzel, Bordeaux (FR); Leo Pierre, Cosnac (FR); Matthieu Feuerstein, Saint Germain les Vergnes (FR); Carlo Kaiser, GT Roden (NL); Pascal Lavoute, Brive (FR)

(73) Assignee: Photonis France, Brive la Gaillarde (FR)

( * ) Notice: Subject to any disclaimer, the term of this patent is extended or adjusted under 35 U.S.C. 154(b) by 696 days.

(21) Appl. No.: 12/746,038

(22) PCT Filed: Dec. 12, 2008

(86) PCT No.: PCT/EP2008/067453

§ 371 (c)(1),
(2), (4) Date: Dec. 13, 2010

(87) PCT Pub. No.: WO2009/074682

PCT Pub. Date: Jun. 18, 2009

(65) Prior Publication Data

US 2011/0079715 A1 Apr. 7, 2011

(30) Foreign Application Priority Data

Dec. 13, 2007 (FR) ..... 07 59826

(51) Int. Cl.
*G01T 1/20* (2006.01)
*H01J 31/50* (2006.01)

(52) U.S. Cl.
CPC ..... *H01J 31/507* (2013.01); *H01J 2231/5016* (2013.01)
USPC ..... 250/362

(58) Field of Classification Search
USPC ..... 250/362
See application file for complete search history.

(56) References Cited

U.S. PATENT DOCUMENTS

| | | | | |
|---|---|---|---|---|
| 5,023,511 | A * | 6/1991 | Phillips | 313/524 |
| 5,493,111 | A * | 2/1996 | Wheeler et al. | 250/207 |
| 5,569,355 | A * | 10/1996 | Then et al. | 438/20 |
| 6,040,657 | A | 3/2000 | Vrescak et al. | |
| 6,657,385 | B2 | 12/2003 | Tomasetti et al. | |
| 6,727,503 | B1 * | 4/2004 | Gerstenmayer | 250/370.09 |
| 2005/0106983 | A1 | 5/2005 | Iosue | |
| 2013/0161535 | A1 | 6/2013 | Nutzel et al. | |

FOREIGN PATENT DOCUMENTS

EP 1 760 758 A2 3/2007

OTHER PUBLICATIONS

French Preliminary Search Report dated Aug. 20, 2008 in corresponding French Application No. 0759826.

* cited by examiner

*Primary Examiner* — David Porta
*Assistant Examiner* — Edwin Gunberg
(74) *Attorney, Agent, or Firm* — Oblon, McClelland, Maier & Neustadt, L.L.P.

(57) ABSTRACT

An image intensifier tube and a night vision system fitted with such a tube. The tube body of the image intensifier tube includes a multilayer ceramic substrate fixed in a sealed manner to an input device and to an output device so as to assure leaktightness of a vacuum chamber delimited by the tube body. The multilayer substrate also maintains a microchannel plate arranged between a photocathode and a phosphorus screen, and supplies voltage to the photocathode, the plate, and the phosphorus screen.

21 Claims, 4 Drawing Sheets

COMPACT IMAGE INTENSIFIER TUBE AND NIGHT VISION SYSTEM FITTED WITH SUCH A TUBE

TECHNICAL FIELD

This invention relates to the field of night vision systems and in particular relates to an image intensifier tube fitted on a night vision system.

STATE OF PRIOR ART

Night vision systems have many applications, for example military, industrial and even domestic, whenever it is essential to be able to see an environment in the dark. For example, night vision goggles or binoculars may be used personally or professionally during night activities, for example worn on a user's head.

A night vision system uses an image intensifier device capable of making a dark environment perceptible to an observer. More precisely, the image intensifier device collects radiation emitted by the environment, particularly the small quantity of visible light and infrared radiation, and amplifies it so that the output is an image of the environment perceptible to the human eye. The light signal at the output from the image intensifier device may be recorded by a recording device, displayed on an external monitor or viewed directly by an observer. In the latter case, image intensifier devices are used in night goggles or binoculars worn by a person on his head so that the output light signal is transmitted directly to the person's eyes. The usual objective is then to have a compact lightweight night vision system.

Conventionally, an image intensifier device comprises an image intensifier tube with three essential elements mounted in a box forming the body of the tube. The tube body, closed at its two ends along the centreline of the tube, delimits an internal vacuum chamber. The three elements are a photocathode, a microchannel plate (MCP) and a phosphorus screen. The photocathode receives incident photons from the outside environment and converts them into photoelectrons according to a pattern corresponding to the image of the observed environment. The MCP amplifies the photoelectrons that are then transformed by the phosphorus screen into an intensified light signal.

The photocathode has a photosensitive semi-transparent layer that can receive incident radiation and when it is excited by a photon with sufficient energy, emits a flow of photoelectrons by photoelectric effect, towards the inside of the tube, the intensity of the flow depending on the radiation intensity. The emitted photoelectrons are then submitted to an electrostatic field which orients them and accelerates them towards the MCP.

The MCP is a high gain electron multiplier that is usually in the form of a fine plate comprising a network of tubes or microchannels that pass through it from an input surface oriented towards the photocathode and towards an output surface oriented towards the phosphorus screen. The MCP is submitted to a potential difference between these two faces so as to create a second electrostatic field. When an incident photoelectron enters into a microchannel and collides with the inside wall of the microchannel, secondary electrons are generated that in turn collide with the wall also generating other secondary electrons. The electrons are directed and accelerated by the second electrostatic field towards the output from the microchannel located in the output face of the MCP. A third electrostatic field is provided between the MCP and the phosphorus screen so as to accelerate electrons towards the phosphorus screen.

The phosphorus screen is arranged close to the output face of the MCP such that the electrons generated by the MCP impact it. The phosphorus screen comprises a phosphorus layer or a layer of any other material capable of emitting a photon by fluorescence when it receives an electron with sufficient energy. Thus, incident electrons reproduce the input image and the phosphorus screen converts this image into a light signal. The phosphorus screen is connected to an output window or to an optical fibre which transmits the light signal to the outside of the tube, for example the display means of night vision goggles.

The photocathode, the MCP and the phosphorus screen are placed inside the tube body, the purpose of which is to mechanically hold the three elements together, to seal the tube vacuum chamber and to supply voltage to the different electrodes provided to generate the different electric fields mentioned. Normally, the tube body is composed of a plurality of rings made of an insulating material onto which metallic rings are brazed to supply voltage to the different electrodes.

Thus, FIG. 1 shows a sectional view of an image intensifier tube A01 according to prior art. The section plane is parallel to an axis A called the axis of the tube. An orthogonal system (R, Z) is shown in which R is the radial direction of the tube A01, and Z is the axial direction of the tube A01 that is also practically the same as the direction of travel of the photons and electrons. Along the direction Z, the tube A01 comprises an input window 11 through which the light signal of the image to be intensify enters into the tube and a photocathode A10 deposited on an inside face of the input window A11. The tube A01 then comprises a MCP A20 and then a phosphorus screen A30 deposited on the inside face of an output window A31. The distances separating firstly the photocathode A10 and the MCP A20 and secondly the MCP A20 and the phosphorus screen A30, are of the order of a tenth of a millimeter. Furthermore, the photocathode A10, the MCP A20 and the phosphorus screen A30 are brought to different electrical potentials so as to create electric fields that orient and accelerate electrons.

The tube body A40 of tube A01 is closed and sealed at a first end by the input window A11 and at its second end opposite the first end by the output window A31. The vacuum is created in the tube body A40 to improve propagation of electrons in the tube A01.

Furthermore, as can be seen in FIG. 1, the tube body A40 comprises a plurality of stacked annular elements fixed to each other in a sealed manner. The input window A11 is supported in a sealed manner on a first conducting support ring A41 located at one end of the tube body A40. Thus, the support ring A41 may be metallic or it may be made of an insulating material on which a metallic film is deposited. A metallic film is deposited on the inside surface of the input window A11 and on the interface between the input window A11 and the photocathode A10, so as to bring the photocathode to a first fixed potential from the outside of the tube body A40.

A first annular insulating spacer A45 made of glass or ceramic is fixed by brazing to the support ring A41. The brazing operation enables the two elements A41 and A45 to be fixed and sealed. A second conducting ring A50 is fixed to the end of the spacer A45 opposite the ring A41. It is connected to the input surface A21 of the MCP A20 using a metallic support ring A51 that extends radially in the direction of the axis A and a metallic contact ring A52, so as to bring the input surface A21 to a second determined potential. A second annular insulating spacer A55 is provided to separate the second conducting ring A50 from a third conducting support ring A60. The third ring A60 extends radially in the direction of the axis A to come into firm contact with the output surface of the MCP A20, and to bring it to a third determined potential.

A third insulating spacer A65 is then fixed between the third conducting ring A60 and a getter A70. The getter A70 creates a vacuum in the vacuum chamber of the tube A01. A fourth spacer A75 is fixed to the surface opposite the getter A70 and an attachment means A80 that keeps the tube A01 fixed to an image intensifier device structure (not shown). A collar A85 is arranged at the output end of the tube body A40 and is fixed in a sealed manner firstly to the attachment means A80 and secondly to the output window A31.

As can be seen, the image intensifier tube according to prior art has a tube body composed of a large number of stacked metallic or insulating parts fixed to each other. A number of problems arise directly caused by the complex structure of the tube body.

The tube length along its axis A is long, for example of the order of 20 mm, due to the large number of parts from which the tube body is made, and its weight is high. The tube length is controlled particularly by the need for thick insulating spacers to prevent any breakdown phenomenon between the metallic rings. This is contrary to the need to have a small lightweight tube so that the tube can be used in night vision goggles usually worn on an observer's head.

Furthermore, it is important that distances separating the photocathode, the MCP and the phosphorus screen, of the order of a tenth of a millimeter, are homogenous along the radial direction of the tube. There is an uncertainty with the distances between the three essential tube elements that is directly dependent on all uncertainties affecting the length of the different parts making up the tube body. Therefore the uncertainty related to the distances between the three elements is high and in particular can disturb the spatial homogeneity of the electrostatic fields, which degrades the output quality of the light signal.

The tube body must also maintain the vacuum in the entire tube. Thus, the different parts of the tube body are fixed to each other in a sealed manner. However, the large number of attachment zones makes a local leak possible which would degrade the quality of the vacuum in the tube and consequently degrade the output signal.

Finally, the large number of parts to be assembled obviously means that the manufacturing procedure for the tube is particularly long, causing a high cost of the image intensifier tube.

PRESENTATION OF THE INVENTION

The purpose of this invention is to at least partly overcome the disadvantages mentioned above and particularly to propose a compact image intensifier tube and a night vision system fitted with such a tube.

To achieve this, the purpose of the invention is an image intensifier tube designed to receive photons from an external environment to output a visible image, said tube comprising:

- a tube body delimiting a vacuum chamber, closed in a sealed manner at a first end by an input device of an incident light signal and a second end opposite the first end along the axial direction of the tube by a light signal output device,
- a photocathode arranged on an internal surface of the input device, that receives photons to generate photoelectrons;
- multiplying means for receiving said photoelectrons to output secondary electrons in response thereto;
- a phosphorus screen arranged on the internal surface of said output device and receiving said secondary electrons to provide a visible image in response thereto.

According to the invention, said tube body comprises a multilayer ceramic substrate fixed in a sealed manner to the input device and to the output device, on which said multiplying means are fixed, and adapted to bring said multiplying means to different electrical potentials.

Thus, the number of parts in the tube body is as small as possible because, unlike prior art in which the tube body comprises several insulating spacers stacked alternately on metallic rings, the tube body according to the invention comprises a single multilayer ceramic substrate. As a result, the tube can be shorter so that it can be more compact and lighter weight than the tube according to prior art. Furthermore, the number of steps in the manufacturing process is reduced, which significantly reduces manufacturing costs. Furthermore, all risks of breakdown are eliminated by avoiding the use of metallic rings in the tube body. The electric fields present in the tube then have a greater spatial homogeneity, which improves the quality of the output signal. Furthermore, attachment zones assuring leak tightness of the tube chamber are reduced, which eliminates risks of leakage and eliminates the use of a getter, essential in prior art. The quality of the vacuum is thus preserved, as is the quality of the output signal. Finally, the tolerance on the distance separating said multiplying means from the photocathode is improved in that it is then only dependent on the uncertainty of the thickness of the multilayer ceramic substrate, rather than the sum of the uncertainties of the thickness of the different parts present in the tube body according to prior art.

Preferably, said multiplying means are a microchannel plate.

Alternatively, said multiplying means are a thin film, or a thin membrane, made of semiconductive material. Preferably, the semiconductive material has a crystalline structure. Preferably, the semiconductive material is selected from the group consisting of monocrystalline or polycrystalline diamond, CaF, MgO, AlN, BN, GaN, InN, SiC, and nitride alloys containing two or more of Al, B, Ga and In. Preferably, the thin film is a diamond film.

The image intensifier tube could also comprise one or more microchannel plate(s), and at least one diamond film.

Said multilayer ceramic substrate may be adapted to bring the photocathode and the phosphorus screen to different electrical potentials.

Preferably, the substrate comprises a plurality of ceramic layers and at least one internal electrical connection arranged between two ceramic layers.

Preferably, at least two internal electrical connections are both located between two neighbouring ceramic layers of said multilayer ceramic substrate.

Advantageously, the substrate comprises a central opening extending along the radial direction of the tube so that photoelectrons can pass from said multiplying means to said phosphorus screen.

In one embodiment of the invention, the substrate is fixed in a sealed manner to the internal surface of the input device by a first conducting attachment means.

Similarly, the substrate may be fixed in a sealed manner to the inside surface of the output device by a second conducting attachment means.

Advantageously, the first and second conducting attachment means are indium-tin seals, indium-bismuth or pure indium seals.

Preferably, the substrate comprises a first and a second internal electrical connection that brings each of the first and second conducting attachment means to a determined electrical potential.

In one embodiment of the invention, said multiplying means are fixed to the substrate by a plurality of conducting attachment means.

Preferably, said multiplying means comprising an input surface and an output surface along the axial direction of the tube, and the substrate comprising an upper surface and a lower surface along the axial direction of the tube, said output surface of said multiplying means is fixed to said upper surface of the substrate by a plurality of conducting attachment means.

Preferably, the conducting attachment means are arranged at regular intervals from each other at a constant distance from the opening along the radial direction of the tube.

Preferably, each conducting attachment means is arranged in a recess located on the upper surface of the substrate, so as to bring said attachment means into contact with at least one internal conducting connection of the substrate.

Advantageously, the output surface of said multiplying means is brought to a determined potential starting from a first set of conducting attachment means through a third internal electrical connection.

Advantageously, the input surface of said multiplying means is brought to a determined potential starting from a second set of conducting attachment means through a fourth internal electrical connection.

Preferably, said third and fourth connections are essentially located in a same plane perpendicular to the axial direction of the tube, and more specifically, between two neighbouring ceramic layers of said substrate.

Preferably, said multiplying means comprises vias passing through the plate from the input surface to the output surface, each via being in contact with a means of attachment of the second set so as to bring the input surface of said multiplying means to a determined potential.

Advantageously, each attachment means of the first set is arranged alternately with an attachment means of the second set. When the plate is biased with a high frequency signal, the distribution of the alternating attachment means prevents any phase shift phenomenon between the potentials of the input surface and the output surface of the plate.

Alternately, the attachment means of the first set being arranged on a first determined sector of the opening, the attachment means of the second set are arranged on a second sector of the opening different from said first sector. In this configuration, the sets of attachment means are horseshoe shaped around the central opening of the substrate.

Preferably, the attachment means between the plate and the substrate are indium balls.

Advantageously, at least one spacing means is arranged in contact between the upper surface of the substrate and the internal surface of the input device so as to define the space between the photocathode and said multiplying means, and so as to precisely fix the space between the photocathode and said multiplying means.

Alternatively, the substrate comprises at least one spacing means arranged on the upper surface of the substrate and coming into contact with the output surface of the photocathode so as to maintain a constant spacing between the photocathode and said multiplying means.

The invention also relates to a night vision system comprising an image intensifier tube defined according to one of the above characteristics.

Other advantages and characteristics of the invention will become clearer after reading the non-limitative detailed description given below.

BRIEF DESCRIPTION OF THE FIGURES

We will now describe embodiments of the invention as non-limitative examples, with reference to the appended drawings in which.

DETAILED PRESENTATION OF A PREFERRED EMBODIMENT

Figure 1:
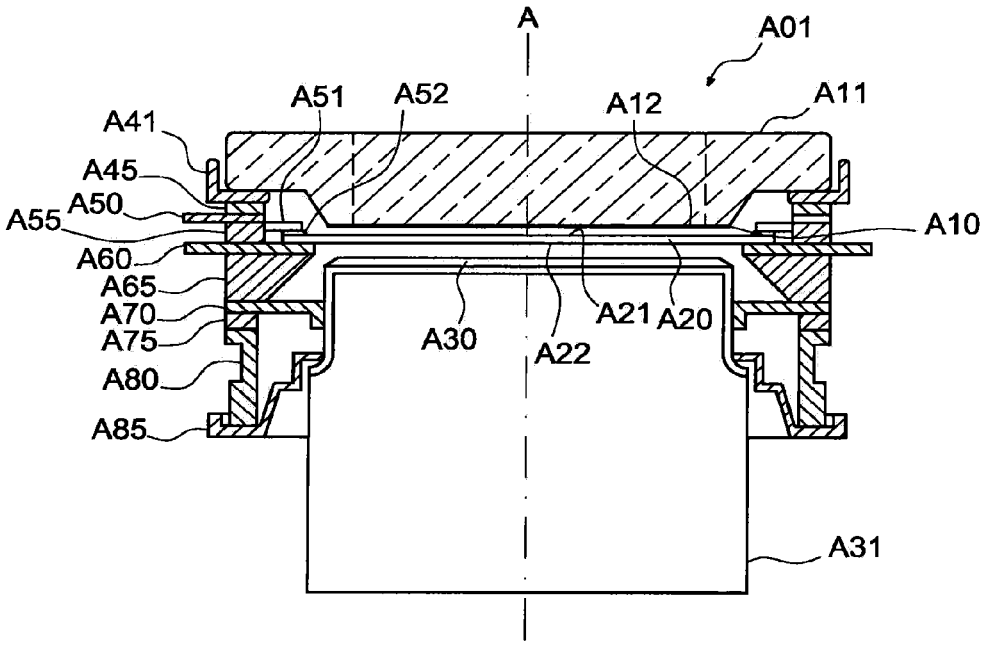
FIG. 1 Prior Art
FIG. 1 is a sectional view of an image intensifier tube according to prior art.
Figure 2:
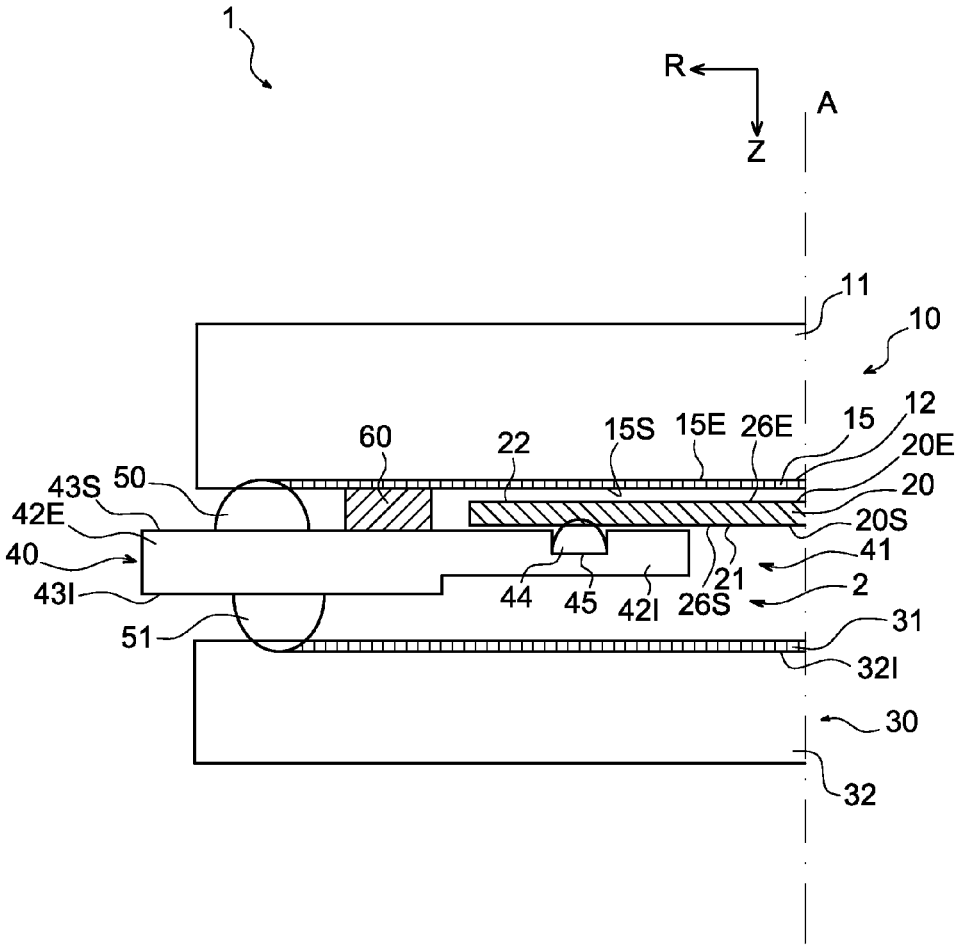
FIG. 2 is a sectional view along the vertical plane diagrammatically showing an image intensifier tube according to the invention.

FIG. 2 shows an image intensifier tube 1 according to the preferred embodiment of the invention. The tube 1 has a substantially cylindrical or tubular shape along an axis A. However, the tube 1 may also have a square, rectangular, hexagonal or any other shaped section. A coordinate system (R, Z) is shown in which R is the radial direction of the tube and Z is the axial direction of the tube, parallel to the A axis. The Z direction can also be considered to be the same as the direction of propagation of the photons and electrons inside the tube 1.

The tube 1 comprises three essential elements arranged along the Z direction, in other words an input device 10, a microchannel plate (MCP) 20 and an output device 30. The tube 1 also comprises a tube body 40, the function of which is to mechanically hold the three elements 10, 20, 30 mentioned above, to define a sealed chamber 2 in cooperation with the elements 10 and 30, and to supply voltage to the different electrodes that will be described later. The three elements 10, 20, 30 are substantially in line along the axis of the tube A.

The input device 10 comprises an input window 11 into which the photons to be intensified emitted by an environment external to the tube 1, arrive into the tube 1. The transparent input window 11, for example made of glass, may be replaced by an optical fibre. The input window 11 comprises an inside surface 12 on which a photoemissive layer of a photocathode 15 is deposited. The photocathode comprises an input surface 15E in contact with the inside surface 12 of the input window 11, and an output surface 15S opposite to the input surface 15E along the direction Z. When incident photons impact the input surface 15E of the photoemissive layer, the photoelectrons are emitted by the output surface 15S of the photoemissive layer by a photoelectric effect, along the direction of the MCP 20.

The MCP 20 is arranged facing the photocathode at a determined distance and is supported by the tube body 40. The MCP 20 comprises an input surface 20E arranged parallel to and facing the output surface 15S of the photocathode 15, and an output surface 20S opposite the input surface 20E along direction Z. The MCP 20 also comprises a first central part 21 called the useful zone, and a second peripheral part 22 called the solid edge, these two parts 21 and 22 extending along the direction R of the tube. The useful zone 21 comprises a plurality of microchannels 23 passing through the MCP from the input surface 20E to the output surface 20S.

The solid edge 22 is arranged at the outside periphery of the MCP 20 and surrounds the useful zone 21. The solid edge 22 is designed to fix the MCP 20 onto the tube body 40 and to bring the input surface 20E to a determined electrical potential and the surface 20S to a determined electrical potential so as to bias the MCP. When an incident photoelectron enters into a microchannel 23 and collides with the inside wall 24 of the microchannel 23, secondary electrons are generated that in turn collide with the wall 24 also generating other secondary electrons. Electrons are directed and accelerated by the electrostatic field towards the output from the microchannel 23 located in the output surface 20S of the MCP 20. The electrons are then oriented and accelerated towards the phosphorus screen 31 by an electrostatic field.

The output device 30 comprises a phosphorus screen 31 deposited on the inside surface 321 of an output window 32. The output window 32, for example made of glass, optically transmits the intensified light signal outside the tube 1. The output window 32 may be replaced by an optical fibre. The phosphorus screen 31 is arranged parallel to the output surface 20S of the MCP 20 and facing this surface 20S such that secondary electrons generated by the MCP 20 collide with it. The phosphorus screen 31 comprises a layer made of phosphorus or any other material capable of emitting a photon when it receives an electron with sufficient energy. Thus, the pattern of the incident image is reproduced by the phosphorus screen 31, by photons emitted by the excited phosphorus. The photons are the transmitted outside the tube 1 through the output window 32 or an optical fibre.

According to the preferred embodiment of the invention, the tube body 40 comprises a substrate made of multilayer ceramic 40. The multilayer ceramic substrate 40 comprises a plurality of thin ceramic layers between which metallisations may be deposited by screen printing. The substrate is monolithic and could be obtained by co-sintering or by others techniques known to the person skilled in the art. The substrate 40 comprises at least one internal electrical connection. Preferably, the substrate comprises four internal electrical connections. Each connection may be located between different ceramic layers or between the same ceramic layers. Preferably, the connections are located between the same ceramic layers so as to reduce the thickness of the substrate 40. After co-sintering the different layers, the internal electrical connections thus made up can supply voltage to the required areas of the substrate 40. The different electrical connections are connected to an external electrical power supply (not shown) to the tube 1 that brings each electrical connection to a determined potential.

Preferably, each of the internal electrical connections is band-shaped or line-shaped and its pattern is essentially located in a plane perpendicular to the direction Z. Some of them are connected to balls 44, as described further below.

The substrate 40 has a substantially circular shape matching the shape of the tube section 1 and extends along the direction. R. The substrate 40 is arranged between the input device 10 and the output device 30. An opening 41 is provided at the centre of the substrate 40 and is aligned substantially along the axis A of the tube, to enable electrons to pass from the MCP 20 to the phosphorus screen 31. Thus, the surface of the opening 41 substantially corresponds to the surface of the useful zone 21 MCP 20. The substrate comprises an inner part 421 arranged around the periphery of the opening 41, and an outer part 42E arranged close to the external periphery of the substrate 40. Furthermore, the surface oriented towards the photocathode 15 is called the upper surface 43S and the surface oriented towards the phosphorus screen 31 is called the lower surface 431. Note that the upper surface 43S is not necessarily contained in a plane perpendicular to the axis A, but there may be offsets in it. In all cases, the upper surface 43S is substantially parallel to the output surface 15S of the photocathode.

The MCP 20 is supported on the substrate 40, more precisely the output surface 20S of the solid edge 22 of the MCP 20 is fixed to the upper surface 43S of the inner part 421 of the substrate 40. The attachment is made by a plurality of indium balls 44, each deposited in a recess 45 formed on the upper surface 43S of the inner part 421, the recesses 45 being at a uniform spacing from each other around the opening 41.

Figure 3:
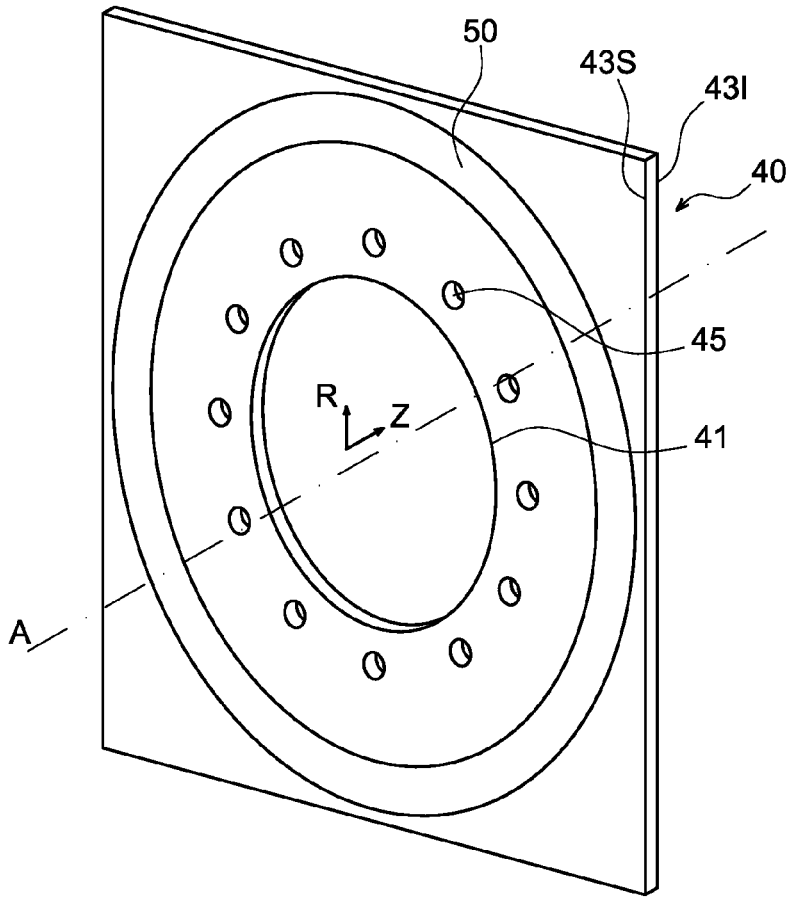
FIG. 3 is a perspective view of the multilayer ceramic substrate provided in the tube according to the invention.

With reference to FIGS. 2 and 3, an indium-tin seal 50 is continuously deposited on the upper surface 43S of the outer part 42E of the substrate 40 around the external circumference of the surface 43S, and comes into contact with the internal surface 12 of the input window 11, so as to fix the multilayer substrate 40 to the input device 10. The leaktight attachment of the seal 50 onto the surfaces 43S and 12 may be made by brazing. The seal 50 may also be made of indium-bismuth or pure indium. If it is pure indium, the attachment between the substrate 40 and the input device 10 is made using a cold closing technique known to those skilled in the art.

Similarly, in order to fix the substrate 40 to the phosphorus screen device 30, an indium-tin seal 51 is deposited continuously on the lower surface 431 of the outer part 42E of the substrate 40, along the outer circumference of the surface 431, and comes into contact with the internal surface 321 of the output window 32. The leaktight attachment of the seal 51 on the surfaces 431 and 321 may be made by brazing. The seal 51 may also be made of indium-bismuth or pure indium. If it is made of pure indium, the attachment between the substrate 40 and the output device 30 is made using a cold closing technique known to those skilled in the art.

Thus, the two seals 50 and 51 not only attach the substrate 40 to the devices 10 and 30 but also seal the vacuum chamber 2. According to the invention, a single part 40, in cooperation with the seals 50 and 51, not only mechanically holds the input device 10, the MCP 20 and the output device 30 together, but also seal the vacuum chamber 2. The number of parts in the tube body 40 is then minimized.

Different electrostatic fields are provided in the tube 1 so as to orient and accelerate the movement of electrons. Thus, a first electrostatic field E1 is provided between the photocathode and the input surface 20E of the MCP 20. A second electrostatic field E2 is provided between the input surface 20E and the output surface 20S of the MCP 20. Finally, a third electrostatic field E3 is provided between the output surface 20S and the phosphorus screen 31. The electric fields E1, E2 and E3 are applied, bringing the different electrodes to different electrical potentials.

Thus, a first electrode 13 is arranged between the inside surface 12 of the input window 11 and the photoemissive layer of the photocathode 15. The electrode 13 may be made by depositing a metallic film by evaporation using a technique known to those skilled in the art. The electrode 13 is connected to an electrical power supply (not shown) through the indium-tin seal 50 itself connected by a metallic connection deposited on the surface 43S of the part 42E to the electrical power supply.

Similarly, an electrode 33 is provided on the inside surface 321 of the output window 32 to connect the phosphorus screen 31 to the indium-tin seal 51. The seal 51 is connected by a metallic connection deposited on the surface 431 of the part 42E to the electrical power supply.

Alternatively, said electrodes 13 and 33 could be connected to the power supply by means which are not deposited on the substrate 40. For instance, wires may directly connect said electrodes 13 and 33 to said power supply.

In order to create three electrostatic fields E1, E2 and E3, the input surface 20E and the output surface 20S of the MCP 20 are brought to different potentials. This is done by depositing a first electrode 26E by metallisation on the useful zone 21 of the input surface 20E of the MCP 20, and a second electrode 26S is deposited on the useful zone 21 of the output surface 20S. Thus, electrodes 13 and 26E cooperate to create the electrostatic field E1, electrodes 26E and 26S cooperate to create the field E2, and electrodes 26S and 33 cooperate to create the field E3.

According to one embodiment of the invention and with reference to FIGS. 2 and 3, the voltage is supplied to electrodes 26E and 26S by indium balls 44. The recesses 45 in each ball 44 are used to bring the balls 44 into contact with the internal electrical connections connected to the electrical power supply. A first set 44A of balls is connected to a first internal electrical connection and a second set 44B of balls is connected to a second internal electrical connection with a potential different from the first connection. Preferably, each ball in a set is adjacent to a ball 44 in the other set. In other words, one ball 44 out of two is brought to a first potential, thus defining the first set 44A, while the other balls 44 are brought to the second potential, thus defining the second set 44B. The first set 44A of balls is connected to the electrode 26S of the output surface 20S.

Preferably, said first and second internal electrical connections are located in a same plane perpendicular to the direction Z, and more specifically, between two neighbouring ceramic layers of said multilayer ceramic substrate 40.

Figure 4:
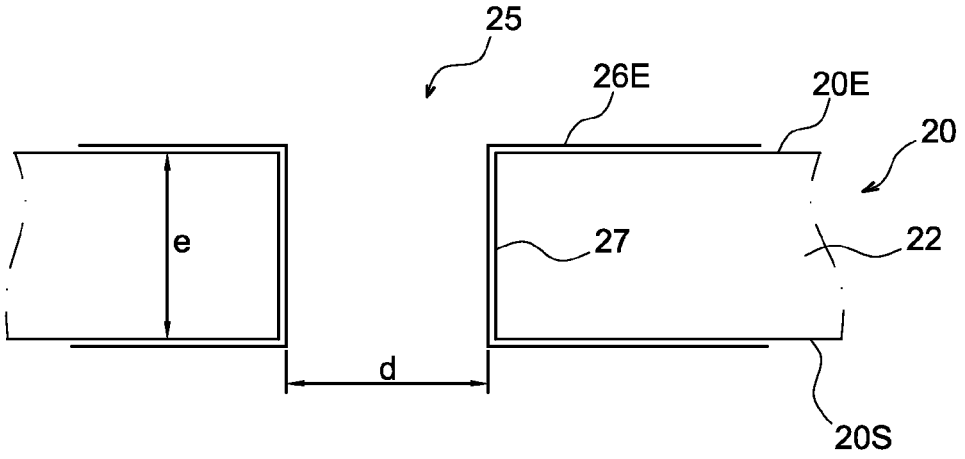
FIG. 4 is a sectional view of a part of the microchannel plate and more particularly shows a via arranged in the solid edge.

As shown in FIG. 4, in order to bring the electrode 26E to the required potential, the balls in the second set 44B are in contact with through-holes, or vias 25, passing through the MCP 20 from the surface 20S to the surface 20E. Each via 25 is located facing each ball 44 in the second set 44B and is in contact with the corresponding ball 44. Each via 25 is then connected to the electrode 26E of the surface 20E of a MCP 20. The vias 55 are holes passing through the MCP along the Z direction. The inside wall 27 of the via 25 is covered by a metallic film deposited by evaporation, so as to make the electrical connection between the ball 44 of the set 44B and the electrode 26E. It is advantageous if the diameter d of the via 25 is substantially equal to or greater than the thickness e of the MCP 20, so that the film will cover the entire height of the wall 27. Thus, when the metal is evaporated, the inside wall 27 of the via 25 is uniformly covered by a metallic film. Thus, the electrode 26E is brought to a potential determined by the balls in the second set 44B connected to the electrical power supply through internal electrical connections provided in the substrate 40.

In another embodiment (not illustrated), the MCP could be replaced with two or more MCP's in tandem to provide additional amplification gain. In such instance, the multilayer ceramic substrate is adapted to hold the MCP's. For instance, the vertical wall of part 421 of said substrate could exhibit recesses on which further balls 44 are provided to connect the MCP's. Moreover, one MCP could be fixed onto the lower surface 431 of the substrate 40, in the same way as onto the upper surface 43S.

In another embodiment (not illustrated), the MCP could be replaced by a thin film, or a thin membrane, made of semiconductive material, as disclosed in U.S. Pat. No. 6,657,385 thereby incorporated by reference.

Preferably, the semiconductive material has a crystalline structure, and could be selected from the group consisting of monocrystalline or polycrystalline diamond, CaF, MgO, AlN, BN, GaN, InN, SiC, and nitride alloys containing two or more of Al, B, Ga and In.

Preferably, the thin film is a diamond film.

In another embodiment (not illustrated), the image intensifier comprises at least one MCP and at least one diamond film. The MCP and the diamond film are fixed onto the multilayer ceramic substrate. In such instance, the substrate is designed to hold these elements.

The substrate comprises internal electrical connections in order to bring these elements to different potentials.

We will now describe operation of the image intensifier tube 1. The incident photons coming from the environment outside the tube 1 and representing an image of this environment enter into the tube 1 through the input window 11 and impact onto the photocathode 15 that releases photoelectrons by the photoelectric effect. Photoelectrons are emitted according to a pattern that is a replica of the image to be intensified. The photoelectrons are accelerated in the direction of the MCP 20 under the effect of the electric field E1. As they pass through the microchannels 23 of the MCP 20, the photoelectrons impact the inside wall 24 of the microchannels 23 and cause emission of a large number of secondary electrons by a secondary emission effect. Each secondary electron in turn impacts on the wall 24 of the microchannel and also causes the emission of secondary electrons. The secondary electrons are accelerated towards the output of the microchannel under the effect of the electric field E2. A shower of secondary electrons exits from each microchannel 23 in which a photoelectron is initially input. The secondary electrons are then directed and accelerated towards the phosphorus screen 31 under the effect of the electric field E3. Each electron interacts with the fluorescent material of the phosphorus screen 31 which, by luminescence, emits photons, the number of which depends on the energy of the electrons. The emitted photons form an image that is the intensified replica of the initial image. The photons are then transmitted outside the tube 1 through the output device 30 towards the display means provided in the night vision system (not shown).

As described above, the vacuum is created in the vacuum chamber 2 of the tube 1. The vacuum is necessary for migration of electrons from the photocathode 15 to the MCP 20 and then to the phosphorus screen 31.

Unlike prior art, there is no need here to use the getter because the risks of a leak are minimized due to the small number of parts making up the tube body 40. The getter is normally provided to maintain the vacuum and compensate for any leaks. The principle of the getter, known to those skilled in the art, consists of using the capacity of some solids to collect gas molecules particularly by adsorption or absorption. The presence of a getter in an image intensifier tube is particularly important when the number of stacked parts making up the tube body is high, as is the case described above for the tube according to prior art. In the preferred embodiment of the invention, the tube body 40 essentially comprises the multilayer substrate 40 fixed in a sealed manner to the input device 10 and to the output device 30. Thus, the number of parts making up the tube body 40 is minimized, which correspondingly reduces the risk of a leak. Furthermore, the use of a getter is no longer essential to maintain the vacuum in the tube. When the tube 1 according to the invention is being made, the tube 1 is directly closed under a vacuum using a technique known to those skilled in the art.

In one embodiment of the invention, at least one spacing means 60 may be provided between the output surface 15S of the photocathode 15 and the upper surface 43S of the multilayer substrate 40, so as to maintain the distance separating the output surface 15S and the input surface 20E of the plate 20. The spacing means is arranged between the seal 50 and the MCP 20 and it may be a ceramic shim or any other insulating material.

According to another embodiment of the invention, the distance separating the photocathode 15 from the MCP 20 may be maintained by a spacing part 60 of the substrate 40 located on the surface 43S of the substrate 40 and extending along the Z direction so as to come into contact with the output surface 15S of the photocathode 15. The spacing part 60 may be in the form of a circular step continuously surrounding the opening 41 or it may be in the form of a plurality of shims uniformly distributed around the opening 41. The height of the spacing part 60 may be controlled or modified when the invention is being manufactured by a height correction step.

The invention claimed is:

1. An image intensifier tube for receiving photons from an external environment and outputting a visible image, comprising:

a tube body delimiting a portion of a vacuum chamber, closed in a sealed manner at a first end by an input device of an incident light signal and a second end opposite the first end along the axial direction of the tube by a light signal output device;

a photocathode arranged on an internal surface of the input device, that receives photons to generate photoelectrons;

multiplying means for receiving the photoelectrons to output secondary electrons in response thereto; and a phosphorus screen arranged on an internal surface of the output device to receive the secondary electrons to provide a visible image in response thereto, wherein the tube body includes a multilayer ceramic substrate coupled in a sealed manner to the input device and to the output device, to which the multiplying means is coupled at a plurality of coupling locations, and adapted to bring the multiplying means to different electrical potentials, the multilayer ceramic substrate having a central opening configured to allow the secondary electrons to pass from the multiplying means to the phosphorus screen, a first face of the multilayer ceramic substrate facing toward the photocathode, and a second face of the multilayer ceramic substrate opposite the first face facing toward the phosphorus screen, wherein the multiplayer ceramic substrate includes a plurality of internal electrical connections, each of which is arranged between two neighboring ceramic layers, for connection to an external electrical power supply, and extends radially outward in a plane perpendicular to the axial direction of the tube from a corresponding one of said plurality of coupling locations, and wherein said multilayer ceramic substrate is coupled in a sealed manner to an internal surface of the input device by a first conducting attachment means consisting of at least one seal made of indium-tin, indium-bismuth or pure indium, which is in direct contact with said internal surface of the input device and in direct contact with said multilayer ceramic substrate.

2. An image intensifier tube according to claim 1, wherein the multiplying means includes a microchannel plate.

3. An image intensifier tube according to claim 1, wherein the multiplying means includes a diamond film.

4. An image intensifier tube according to claim 1, wherein the multilayer ceramic substrate is further adapted to bring the photocathode and the phosphorus screen to different electrical potentials.

5. An image intensifier tube according to claim 1, wherein the plurality of internal electrical connections of the multilayer ceramic substrate include first and second internal electrical connections to bring each of the first and second conducting attachment means to a determined electrical potential.

6. An image intensifier tube according to claim 1, wherein the multiplying means is coupled to the multilayer ceramic substrate at the plurality of coupling locations by a plurality of conducting attachment means, which is different from said first conducting attachment means.

7. An image intensifier tube according to claim 6, wherein the multiplying means includes an input surface and an output surface along the axial direction of the tube body, and the multilayer ceramic substrate includes an upper surface and a lower surface along the axial direction of the tube body, an output surface of the multiplying means is coupled to the upper surface of the multilayer ceramic substrate at the plurality of coupling locations by the plurality of conducting attachment means.

8. An image intensifier tube according to claim 6, wherein the plurality of conducting attachment means are arranged at regular intervals from each other at a constant distance from the central opening along a radial direction of the tube body.

9. An image intensifier tube according to claim 7, wherein each said conducting attachment means is arranged in a corresponding recess located on the upper surface of the multilayer ceramic substrate, so that the corresponding conducting attachment means is put into contact with at least one internal electrical connection of the plurality of internal electrical connections of the multilayer ceramic substrate.

10. An image intensifier tube according to claim 9, wherein the output surface of the multiplying means is brought to a determined potential starting from a first set of said conducting attachment means through a first internal electrical connection of the plurality of internal electrical connections, and the input surface of the multiplying means is brought to a determined potential starting from a second set of said conducting attachment means through a second internal electrical connection of the plurality of internal electrical connections.

11. An image intensifier tube according to claim 10, wherein the first and second internal electrical connections are located in a same plane perpendicular to the axial direction of the tube body, said same plane being located under the output surface of the multiplying means, and wherein the multiplying means includes a microchannel plate having vias passing therethrough, from the input surface to the output surface thereof, each said via being in contact with a corresponding one of said conducting attachment means of the second set so as to bring the input surface of said multiplying means to the determined potential.

12. An image intensifier tube according to claim 11, wherein the first set of conducting attachment means is arranged alternately with the second set of conducting attachment.

13. An image intensifier tube according to claim 11, wherein the first set of conducting attachment means is arranged in a first determined sector of the tube body, and the second set of conducting attachment means is arranged in a second sector of the tube body different from the first sector.

14. An image intensifier tube according to claim 7, wherein each of the plurality of conducting attachment means includes an indium ball.

15. An image intensifier tube according to claim 1, wherein at least one spacing means is arranged in contact with an upper surface of the multilayer ceramic substrate and with an output surface of the photocathode so as to maintain a constant spacing between the photocathode and the multiplying means.

16. An image intensifier tube according to claim 1, wherein the multilayer ceramic substrate includes at least one spacing means arranged on an upper surface of the multilayer ceramic substrate and coming into contact with an output surface of the photocathode so as to maintain a constant spacing between the photocathode and said multiplying means.

17. A night vision system comprising an image intensifier tube according to claim 1.

18. An image intensifier tube according to claim 1, wherein the tube body, the photocathode, the multiplying means, and the phosphorus screen overlap in the axial direction.

19. An image intensifier tube according to claim 1, wherein said multilayer ceramic substrate is coupled to an internal surface of the output device by a second conducting attachment means consisting of at least one seal made of indium-tin, indium-bismuth or pure indium, which is in direct contact with said internal surface of the output device and in direct contact with said multilayer ceramic substrate.

20. An image intensifier tube according to claim 19, wherein said multilayer ceramic substrate is coupled in a sealed manner to the internal surface of the output device by the second conducting attachment means.

21. An image intensifier tube according to claim 1, wherein each of the internal connections extends exclusively radially in a plane perpendicular to the axial direction of the tube, and wherein the photocathode, the multiplying means and the phosphorous screen extend one after the other in the axial direction.

* * * * *